US006824355B2

(12) United States Patent
Behrendt et al.

(10) Patent No.: US 6,824,355 B2
(45) Date of Patent: Nov. 30, 2004

(54) DISTRIBUTOR FOR AN EXHAUST GAS TURBINE WITH AN AXIAL FLOW

(75) Inventors: Detlef Behrendt, Rheinheim (DE); Martin Seiler, Wettingen (CH); Jozef Baets, Baden (CH)

(73) Assignee: ABB Turbo Systems AG, Baden (CH)

( * ) Notice: Subject to any disclaimer, the term of this patent is extended or adjusted under 35 U.S.C. 154(b) by 72 days.

(21) Appl. No.: 10/221,661

(22) PCT Filed: Mar. 6, 2001

(86) PCT No.: PCT/CH01/00139

§ 371 (c)(1),
(2), (4) Date: Sep. 16, 2002

(87) PCT Pub. No.: WO01/69044

PCT Pub. Date: Sep. 20, 2001

(65) Prior Publication Data

US 2003/0049120 A1 Mar. 13, 2003

(30) Foreign Application Priority Data

Mar. 17, 2000 (DE) ..... 100 13 335

(51) Int. Cl.[7] ..... F01D 17/16
(52) U.S. Cl. ..... 415/160
(58) Field of Search ..... 415/160, 164, 415/166, 191

(56) References Cited

U.S. PATENT DOCUMENTS 4,003,675 A * 1/1977 Stevens et al. ..... 415/150
4,618,311 A * 10/1986 Miura et al. ..... 415/149.4
4,979,874 A * 12/1990 Myers ..... 415/160

FOREIGN PATENT DOCUMENTS

| | | |
|---|---|---|
| DE | 3623001 C1 | 7/1987 |
| DE | 4100224 C2 | 5/1994 |
| EP | 0131719 | 5/1987 |

* cited by examiner

*Primary Examiner*—Ninh H. Nguyen
(74) *Attorney, Agent, or Firm*—Burns, Doane, Swecker & Mathis, L.L.P.

(57) ABSTRACT

The guide-vane system serves to change the position of the guide vanes of an axial-flow exhaust-gas turbine of a turbocharger. The guide vanes are arranged axially symmetrically to the turbine axis in a flow passage carrying exhaust gas and can be pivoted by a pivoting device in each case about a radially directed axis. A vane shank led radially outward from the flow passage through a casing wall is attached to each of the guide vanes. With its part directed outward, the vane shank is mounted so as to be rotatable about the pivot axis. The pivoting device contains an adjusting ring, arranged outside the flow passage and rotatable about the turbine axis, and also an adjusting lever which transmits a torque from the adjusting ring to the vane shank of each guide vane. The adjusting ring is mounted with its outside on rolling elements which are each designed as one-armed levers and are mounted so as to be pivotable on a component of a casing wall, this component being designed as a supporting ring. This guide-vane system is characterized by high reliability even under heavy operating conditions.

10 Claims, 3 Drawing Sheets

DISTRIBUTOR FOR AN EXHAUST GAS TURBINE WITH AN AXIAL FLOW

FIELD OF THE INVENTION

Background of the Invention

The invention is based on a guide-vane system for an axial-flow exhaust-gas turbine connected upstream of the guide-vane system.

Such a guide-vane system is described, for example, in EP 0 131 719 B1, in particular in an embodiment according to FIGS. 3 to 5. In this guide-vane system, an adjusting ring constantly acted upon by an adjusting force in one direction is provided concentrically to the turbine impeller, this adjusting ring being arranged radially on the outside in the flow passage. Each of the guide vanes is pivotable about a radially oriented axis located in the region of the leading vane edge. The trailing edge of each guide vane bears against an end face of the adjusting ring. By adjusting the adjusting ring parallel to the turbine axis, the guide vanes can be pivoted between two end positions, and a uniform inflow to the turbine impeller can thus be achieved. Depending on the intensity of the exhaust-gas flow, the guide vanes are automatically adjusted in the most favorable angular position in each case.

DE-C1-36 23 001 and DE-C2-41 00 224 each disclose guide-vane systems in which a vane shank directed radially outward through a casing wall from the flow passage is attached to each of the guide vanes. With its part directed outward, the vane shank is mounted so as to be rotatable about a pivot axis. In the guide-vane system disclosed in DE-C2-41 00 224, the guide vanes are adjusted by means of a toothed segment which is fastened to each shank end and in each case interacts with a toothed rim arranged outside the flow passage and rotatable about the turbine axis.

In the guide-vane system in DE-C1-36 23 001, the guide vanes are adjusted by an adjusting ring, arranged outside the flow passage and rotatable about the turbine axis, and by an adjusting lever which transmits a torque from the adjusting ring to the vane shank of each guide vane. The adjusting ring is mounted on connecting straps of a fastening ring in a rotatable manner by means of rolling elements, the fastening ring being fastened to the turbine casing. On account of the high forces which have to be transmitted during the adjustment of the adjusting ring, this design involves the risk of the components jamming and of self-locking occurring.

SUMMARY OF THE INVENTION

The invention as defined in the patent claims achieves the object of specifying a guide-vane system of the type mentioned at the beginning, which, despite a simple construction, is characterized by high reliability even under heavy operating conditions.

According to the invention, an adjusting ring, which is part of a guide-vane system of the type mentioned at the beginning, is mounted with its outer surface on rolling elements which are each designed as one-armed levers which are mounted so as to be pivotable on a component of a casing wall, this component being designed as a supporting ring. Self-locking of the guide-vane system is countered by this mounting. The guide-vane system is therefore characterized by high operational reliability and a long service life and can also be acted upon by adjusting force in an extremely simple manner.

It is especially advantageous to design those ends of the lever arms which are remote from the supporting ring in such a way that in each case a guide lug fastened to the adjusting ring can engage in the lever arm. It is likewise very favorable to provide guide grooves in these ends, the guide grooves in each case guiding a section of the adjusting ring. The guide grooves each have a groove root which rests on the outer surface of the adjusting ring and is curved in the opposite direction to the outer surface and on which a section of the outside of the ring can roll.

Undesirably high bearing forces on the vane shank are avoided if that part of the vane shank which is directed outward is mounted at two bearing points which are radially offset from one another. The bearing points are advantageously arranged in that component of the casing wall which is designed as supporting ring. The supporting ring and the guide vanes, guided at the bearing points in a pivotable manner, can then be fitted in the exhaust-gas turbine in an extremely simple manner or, if desired, can easily be removed again in a simple manner. Low bearing forces at the two bearing points are definitely ensured if the bearing points are situated far apart. The supporting ring therefore has a large overall height in the radial direction.

In order to protect the supporting ring from large temperature differences and thus high thermal stresses, which may impair the reliability and service life of the guide-vane system, the supporting ring is screened on its inside from the flow passage carrying hot exhaust gases by a relieving ring defining the flow passage on the outside. Although the supporting ring comes into contact with ambient air on its outside, high thermal stresses can be greatly reduced in this way.

In order to ensure a simple and reliable adjustment of the guide vanes, the adjusting levers provided in the guide-vane system according to the invention should in each case be connected at one of their ends to the vane shank and should be guided at their other end in a groove of the adjusting ring. This can advantageously be achieved with simple means by the adjusting lever being slipped onto the vane shank, and by a spacer supported on the adjusting ring being fastened to the adjusting lever. The spacer then ensures that, irrespective of the position of the adjusting lever, there is always reliable and effective transmission of force from the adjusting ring to the vane shank, and that self-locking of the guide-vane system according to the invention is definitely avoided. If there is no spacer, the adjusting lever, during operation of the guide-vane system, could otherwise be displaced away from the vane shank in the direction of the adjusting ring on account of external forces, such as engine vibrations for example. During the adjustment of the guide-vane system, the adjusting ring would then have to push back the adjusting lever against the high frictional forces of the slip-on connection, which could lead to jamming and to self-locking of the guide-vane system. Reliable and effective transmission of force is also ensured when the adjusting lever is slipped onto the vane shank and when a locking element engaging behind the vane shank is fastened to the adjusting lever. This transmission of force is distinguished by an especially high degree of reliability, since, unlike the spacer, the locking element is only loaded with relatively low deformation forces during operation of the guide-vane system. In each case, however, it is highly advisable to design the adjusting lever like a spherical head at its end guided in the groove of the adjusting ring, since force or torque is then transmitted virtually free from backlash from the adjusting ring to the vane shank. For space-saving reasons, it is advisable to connect each of the adjusting levers to the vane shank between the two bearing points.

If a cooling passage which can be connected to a coolant source is formed in the supporting ring and is directed via the casing leadthroughs of the vane shanks into the flow passage, the service life and operational reliability of the guide-vane system according to the invention are additionally increased. At the same time, the escape of hot and aggressive exhaust gas from the flow passage can thereby be avoided with great certainty.

It is advisable to attach the vane shank to the guide vane in such a way that the pivot axis runs between the leading edge of the guide vane and a line of the guide vane which connects the vane pressure points. The vanes are then always loaded with a defined torque produced by the exhaust-gas flow. Under certain operating conditions, vibration of the guide vane, which otherwise possibly develops, can thus definitely be avoided or at least substantially suppressed. If the guide-vane system fails, the guide vanes are then opened by the exhaust-gas flow, as a result of which the speed of the exhaust-gas turbine is reduced and overspeeding is avoided.

BRIEF DESCRIPTION OF THE DRAWINGS

The invention is explained in more detail below with reference to exemplary embodiments. In the drawing.

DETAILED DESCRIPTION OF THE INVENTION

Figure 1:
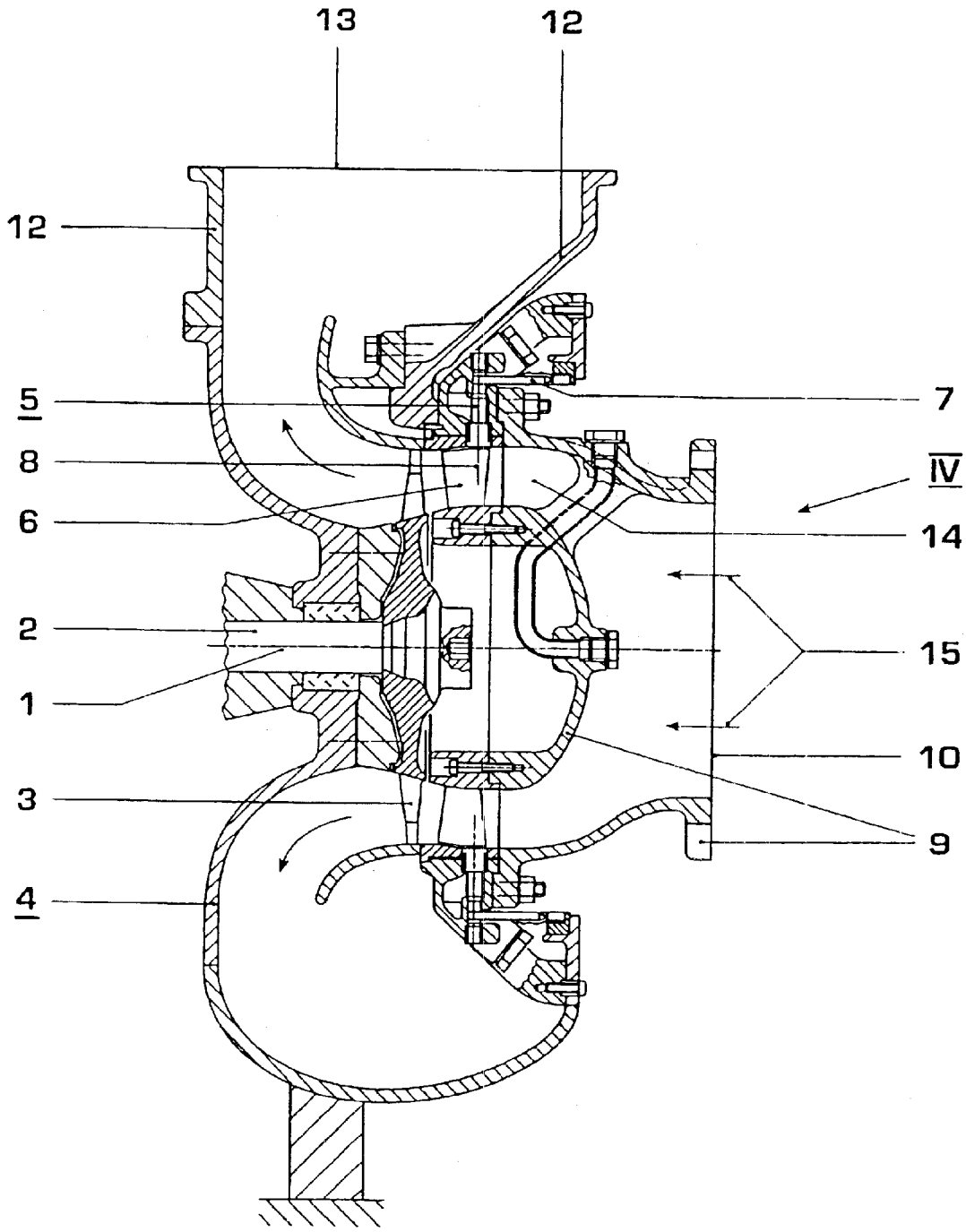
FIG. 1 shows a sectional elevation along the turbine axis through the turbine part of an exhaust-gas turbocharger with a first embodiment of the guide-vane system according to the invention.

In all the figures, the same reference numerals relate to parts which act in the same way. Of an exhaust-gas turbocharger, only the turbine part with an exhaust-gas turbine is shown in FIG. 1. This exhaust-gas turbine has a rotor 2, rotatable about an axis 1 and having a turbine impeller and moving blades 3 fastened thereto, and also a turbine casing 4, and a guide-vane system 5 with a ring of adjustable guide vanes 6, arranged axially symmetrically to the turbine axis 1, and a pivoting device 7. The guide vanes 6 can each be pivoted into any desired angular positions between two end positions by turning them about an axis 8 run in the radial direction.

The rotor 2 is led in a gas-tight manner out of the turbine casing 4 to a bearing point (not shown) and carries a compressor impeller (which cannot be seen from FIG. 1) at its left-hand end in FIG. 1.

The turbine casing 4 contains a gas-inlet casing 9 with an axially symmetrical inlet opening 10 and a gas-outlet casing 12 with a radially oriented outlet opening 13. A flow passage 14 defined by the turbine casing 4 extends between inlet opening 10 and outlet opening 13. Hot exhaust gas 15 (symbolized by arrows) from an exhaust-gas source (not shown), in particular an internal combustion engine, is fed through the inlet opening 10. This hot exhaust gas 15 is first of all directed in a section of the flow passage 14 oriented in the direction of the turbine axis 1. In this section, the exhaust gas 15 is directed via the guide vanes 6 and the moving blades 3. Downstream of the moving blades 3, the exhaust gas 15 enters a section of the flow passage 14 which is defined by the gas-outlet casing 12 and in which it is directed away outward from the axis 1 and is finally removed from the turbine casing 4 via the outlet opening 13.

Figure 2:
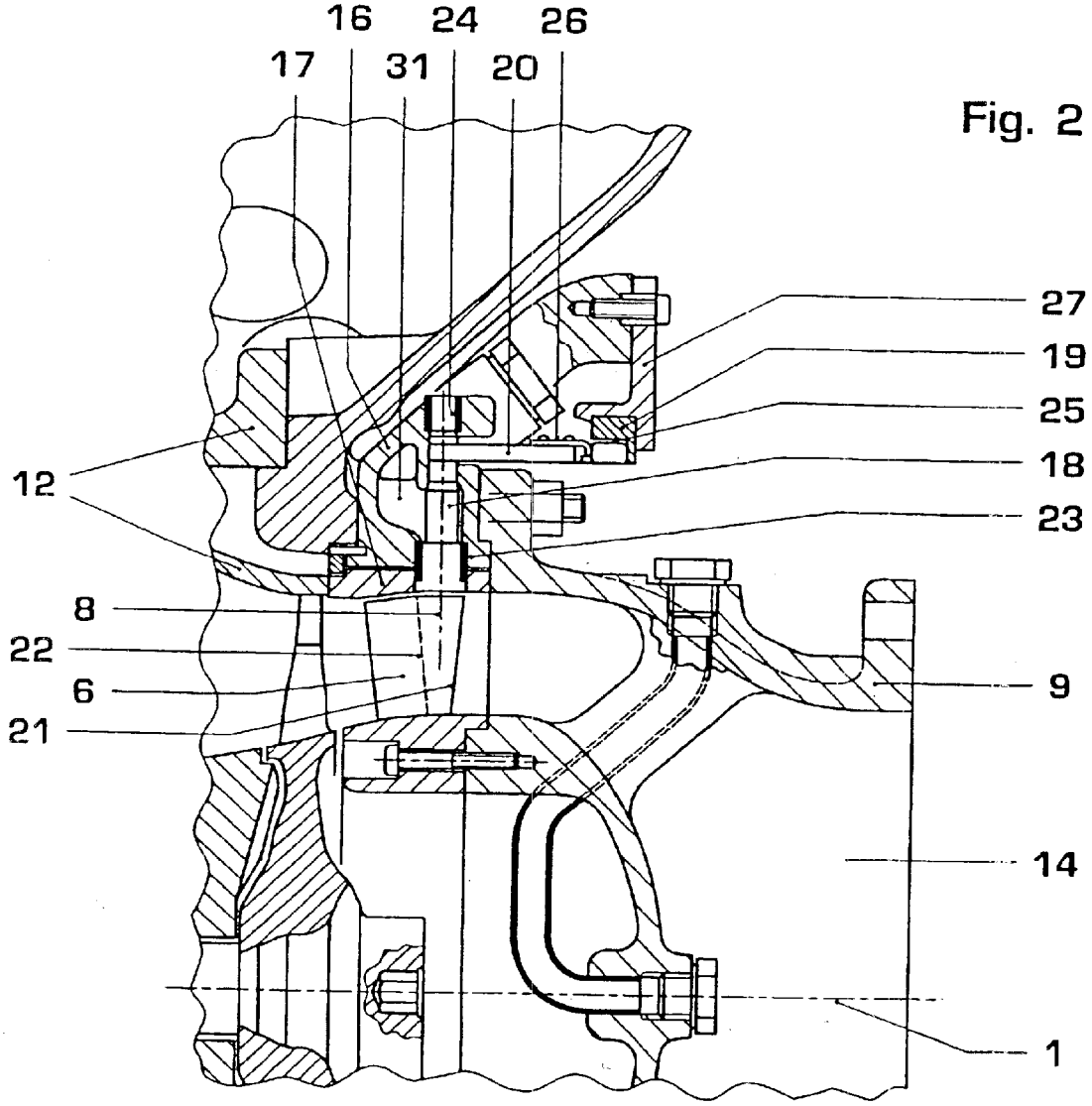
FIG. 2 shows an enlarged detail from FIG. 1.

The details of the guide-vane system 5 can be seen from FIG. 2. The guide-vane system 5 is held on a supporting ring 16, which is clamped in place between the gas-inlet casing 9 and the gas-outlet casing 12 by means of screws. Furthermore, a relieving ring 17 thermally isolated from the supporting ring 16 is clamped in place between the two casings 9 and 12, and this relieving ring 17 defines the flow passage 14 radially on the outside in the region of the guide vanes 6 and thereby screens and thus thermally relieves the supporting ring 16 relative to the direct effect of the hot exhaust gases. A vane shank 18 attached to each of the guide vanes 6 is directed radially outward from the flow passage 14 through the rings 17 and 16, which act as a casing wall. With its part directed outward, the vane shank 18 is mounted so as to be rotatable about the pivot axis 8. The rotary movement is initiated by an adjusting ring 19, which is arranged outside the flow passage 14 and can be rotated about the turbine axis 1, and by an adjusting lever 20 which transmits a torque from the adjusting ring 19 to the vane shank 18 of each guide vane.

It can be seen that the vane shank 18 is attached to the guide vane 6 in such a way that the pivot axis 8 runs between the leading edge 21 of the guide vane and a line 22 of the guide vane which connects the vane pressure points. This ensures that the exhaust-gas flow always loads the guide vane 6 with a defined torque, as a result of which undesirable fluttering and vibration of the guide vane during operation of the exhaust-gas turbine are largely suppressed.

That part of the vane shank 18 which is directed outward is mounted at two points 23, 24 which are radially offset from one another. The two bearing points 23, 24 are arranged in the supporting ring 16 used as a section of the casing 4. Since the relieving ring 17 is located between supporting ring 16 and flow passage 14, the supporting ring 16 may be amply dimensioned in the radial direction without having to fear that it will be subjected to undesirably high thermal stresses. The two bearing points 23 and 24 may therefore be arranged relatively far apart in the radial direction, as a result of which high bearing forces can be kept away from the bearing points 23, 24.

The adjusting lever 20 is connected at its one end to the vane shank 18 by slipping it on. In the slip-on connection shown in FIG. 2, the end of the vane shank 18 has two claws which are arranged like fork prongs and are slipped onto two parallel-sided retaining surfaces of the vane shank 18. The retaining surfaces are arranged between the two bearing points 23, 24. In this way, space can be saved in the radial direction. At its other end, the adjusting lever 20 is guided in a groove 25 of the adjusting ring 19. This groove 25 is defined by two groove walls which are directed essentially radially and, as viewed in the peripheral direction of the adjusting ring 19, are at a distance from one another which is slightly larger than the diameter of the adjusting lever 20. The depth of the groove 25 is also dimensioned to be slightly larger than the diameter of the adjusting lever 20. Due to this dimensioning of the groove 25, guidance of the adjusting lever 20 without jamming is ensured when performing a pivoting movement about the pivot axis 8, this pivoting movement being effected by turning the adjusting ring 19. A spacer 26 fastened to the adjusting lever 20 and supported on the adjusting ring 19 ensures that the slip-on connection between adjusting lever 20 and vane shank 18 is not impaired when the pivoting movement is being performed.

Figure 3:
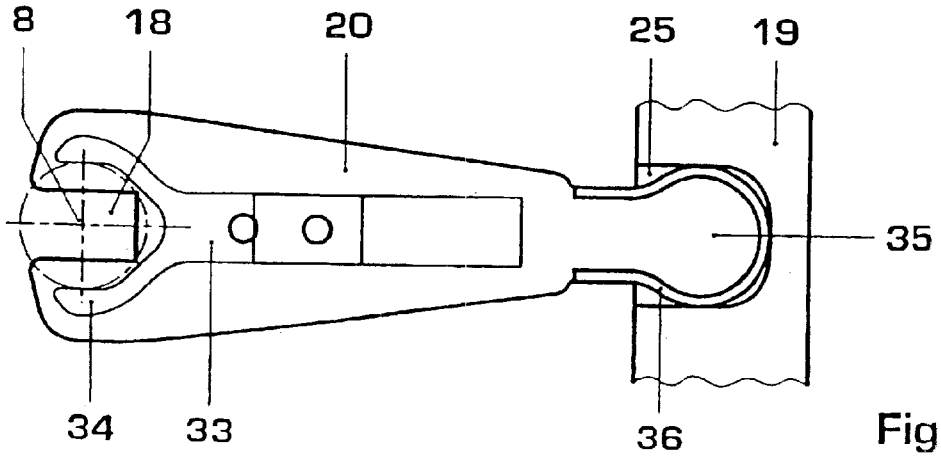
FIG. 3 shows a plan view of an adjusting lever of a second embodiment of the guide-vane system according to the invention.

An adjusting lever 20 of a further embodiment of the guide-vane system 5 according to the invention is shown in FIG. 3. This adjusting lever is also slipped onto the vane shank 18. However, unlike the adjusting lever 20 described above, a leaf-shaped locking element 33 formed from steel sheet is fastened to this adjusting lever 20. This locking element 33 has an elastically deformable fork-shaped end 34. When the adjusting lever 20 is slipped onto the cylindrical vane shank 18, the fork 34 is first of all expanded and, after the slip-on operation has been completed, engages behind the vane shank 18 while forming an expanded connection. In order to hold the adjusting lever 20 as far as possible free from backlash in the radial direction, two planar side faces (which can be seen from from FIG. 3) are formed in the cylindrical vane shank 18 merely in the region of the slip-on connection with the adjusting lever 20. The transmission of torque from the adjusting ring 19 to the vane shank is characterized by the fact that it is ensured to an especially high degree, since, unlike the spacer 26, the locking element 33 is loaded only with relatively low deformation forces during operation of the guide-vane system.

It can also be seen from FIG. 3 that the adjusting lever 20 is designed like a spherical head 35 at its end guided in the groove 25 of the adjusting ring 19. A spherical surface 36, which is present here at least in sections, rolls mainly on the side faces of the groove 25 when the adjusting lever 20 pivots about the pivot axis 8 as a result of the adjusting ring 19 being turned. Force or torque can thus be transmitted virtually free from backlash from the adjusting ring 19 to the vane shank 18. This advantageous design and guidance of the adjusting lever in the groove 25 may also be provided in the case of the adjusting lever 20 described above in connection with FIG. 2.

Figure 4:
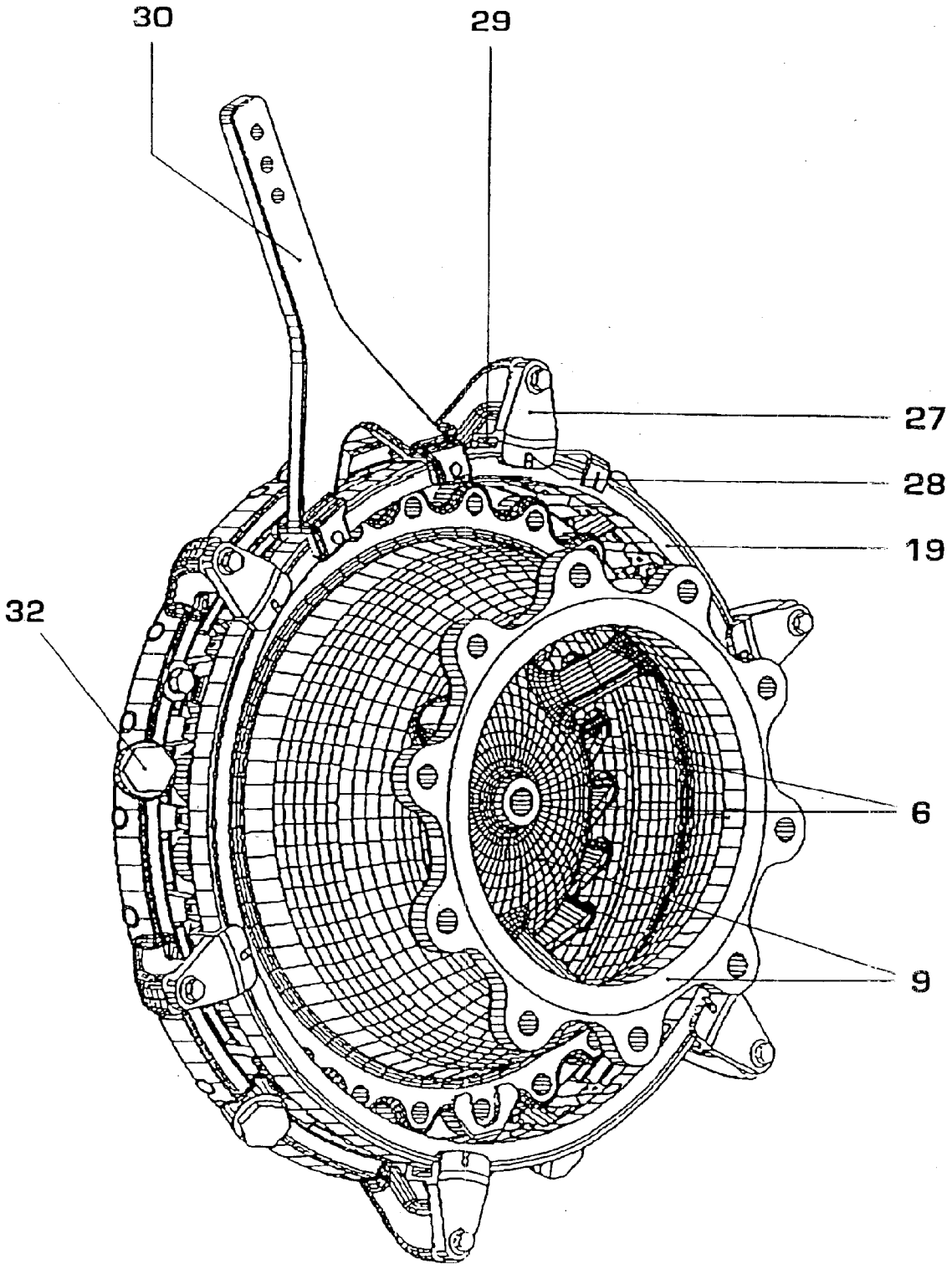
FIG. 4 shows a perspective plan view in the direction of arrow IV of the gas-inlet casing and the guide-vane system of the turbine part according to FIG. 1.

The adjusting ring 19 is mounted with its outer surface on rolling elements. As can be seen in particular from FIG. 4, these rolling elements are designed as one-armed levers 27 mounted so as to be pivotable on the supporting ring 16. Provided at that end of each lever 27 which is remote from the supporting ring 16 is a slot link in which a guide lug 28 fastened to the adjusting ring 19 engages. Furthermore, a guide groove 29 which serves to accommodate a section of the adjusting ring 19 is also formed in this end of the lever and has a groove root which rests on the outer surface of the adjusting ring 19, is curved in the opposite direction to the outer surface and serves as a rolling surface. When the adjusting ring 19 is turned, which is initiated via a remote control and a lever 30, the sections of the outer surface of the adjusting ring 19 which are guided in the grooves 29 roll on the groove root while the levers 27 are pivoted at the same time. Self-locking of the adjusting ring 19 during a turning movement is thus reliably avoided.

It can be seen from FIG. 2 that a passage 31 is formed in the supporting ring 16. After removal of a cap plug 32 (FIG. 4), this passage can be connected to a coolant source, for instance the outlet of a charge-air cooler. The passage 31 is directed into the flow passage 14 via the casing leadthroughs for the vane shanks 18. Compressed air directed in the passage provides for effective cooling of the guide-vane system 5 and, through spilling over into the flow passage 14, prevents the ingress of hot exhaust gases into the guide-vane system.

List of Designations

1 Turbine axis
2 Rotor
3 Moving blades
4 Turbine casing
5 Guide-vane system
6 Guide vane
7 Pivoting device
8 Pivot axis
9 Gas-inlet casing
10 Inlet opening
12 Gas-outlet casing
13 Outlet opening
14 Flow passage
15 Exhaust-gas flow
16 Supporting ring
17 Relieving ring
18 Vane shank
19 Adjusting ring
20 Adjusting lever
21 Leading edge
22 Line of the pressure points
23, 24 Bearing points
25 Groove
26 Spacer
27 Lever
28 Guide lug
29 Guide groove
30 Lever
31 Cooling passage
32 Cap plug
33 Locking element
34 Fork-shaped end
35 Spherical head
36 Spherical surface

What is claimed is:

1. A guide-vane system for an axial-flow exhaust-gas turbine, comprising: a casing wall defining an exhaust gas flow passage;

guide vanes which are arranged symmetrically about the turbine axis in a flow passage and of which each has a vane shank extending radially outward from the flow passage through the casing wall, a pivoting device, for pivoting the guide vanes about a pivot axis defined by the vane shank, the pivoting device having an adjusting ring mounted outside the flow passage with its outer surface on rolling elements and rotatable about the turbine axis, an adjusting lever transmitting a torque from the adjusting ring to the vane shank of each guide vane, and the rolling elements being in the form of one-armed levers which are mounted so as to be pivotable on a supporting ring.

2. The guide-vane system as claimed in claim 1, including a guide lug fastened to the adjusting ring, the guide lug having at that end of each lever which is remote from the supporting ring, and having a guide groove formed with a groove root which rests on the outer surface of the adjusting ring, is curved in the opposite direction to the outer surface and serves as a rolling surface.

3. The guide-vane system as claimed in claim 1, wherein that part of the vane shank which is directed outward is mounted at two points in the supporting ring which are radially offset from one another.

4. The guide-vane system as claimed in claim 1, wherein the supporting ring is thermally relieved by a relieving ring defining the flow passage on the outside.

5. The guide-vane system as claimed in claim 1, wherein the adjusting lever is connected to the vane shank between the two bearing points.

6. The guide-vane system as claimed in claim 1, wherein the adjusting lever is detachably connected to the vane shank and is secured free from backlash between vane shank and adjusting lever by means of an anti-backlash device.

7. The guide-vane system as claimed in claim 6, wherein the adjusting lever is slipped onto the vane shank, and the anti-backlash device is a spacer supported on the adjusting ring.

8. The guide-vane system as claimed in claim 6, wherein the adjusting lever is slipped onto the vane shank, and the anti-backlash device is a locking element engaging behind the vane shank.

9. The guide-vane system as claimed in claim 1, wherein a cooling passage which can be connected to a coolant source is formed in the supporting ring and is directed via the casing leadthroughs of the vane shanks into the flow passage.

10. The guide-vane system as claimed in claim 1, wherein the vane shank is connected to the guide vane in such a way that the pivot axis runs between the leading edge of the guide vane and a line of the guide vane which connects the vane pressure points.

* * * * *